US010066815B2

(12) United States Patent
Chen

(10) Patent No.: US 10,066,815 B2
(45) Date of Patent: Sep. 4, 2018

(54) DIRECT-INSERTING SMALL CONNECTOR AND LED LAMP USING SAME

(71) Applicant: Bingshui Chen, Xiamen (CN)

(72) Inventor: Bingshui Chen, Xiamen (CN)

( * ) Notice: Subject to any disclaimer, the term of this patent is extended or adjusted under 35 U.S.C. 154(b) by 425 days.

(21) Appl. No.: 14/786,984

(22) PCT Filed: Mar. 20, 2014

(86) PCT No.: PCT/CN2014/073755
§ 371 (c)(1),
(2) Date: Oct. 25, 2015

(87) PCT Pub. No.: WO2015/139258
PCT Pub. Date: Sep. 24, 2015

(65) Prior Publication Data

US 2016/0069547 A1 Mar. 10, 2016

(51) Int. Cl.

| | |
|---|---|
| ***H01R 12/00*** | (2006.01) |
| ***F21V 21/002*** | (2006.01) |
| ***F21V 23/06*** | (2006.01) |
| ***F21V 23/00*** | (2015.01) |
| ***H01R 12/57*** | (2011.01) |
| ***F21K 9/238*** | (2016.01) |
| *H01R 12/73* | (2011.01) |
| *H01R 13/11* | (2006.01) |
| *F21K 9/23* | (2016.01) |
| *F21Y 115/10* | (2016.01) |

(52) U.S. Cl.
CPC ..... *F21V 21/002* (2013.01); *F21K 9/238* (2016.08); *F21V 23/006* (2013.01); *F21V 23/06* (2013.01); *H01R 12/57* (2013.01); *F21K 9/23* (2016.08); *F21Y 2115/10* (2016.08); *H01R 12/737* (2013.01); *H01R 13/113* (2013.01)

(58) Field of Classification Search
CPC ..... F21V 23/06; F21V 23/006; F21V 21/002; H01R 13/187; H01R 13/113; H01R 33/18; H01R 12/716; H01R 12/718; F21K 9/23; F21K 9/238; H05K 2201/10106
USPC ..... 439/38
See application file for complete search history.

(56) References Cited

U.S. PATENT DOCUMENTS

| | | | | |
|---|---|---|---|---|
| 9,054,450 | B2 * | 6/2015 | Nagasaki | H01R 12/585 |
| 9,151,480 | B2 * | 10/2015 | Mostoller | F21K 9/00 |
| 9,196,891 | B2 * | 11/2015 | Tsuchiya | H01M 2/202 |
| 9,395,074 | B2 * | 7/2016 | Hussell | F21V 29/004 |
| 9,397,432 | B2 * | 7/2016 | Yukutake | H01R 13/46 |

(Continued)

*Primary Examiner* — Evan Dzierzynski
*Assistant Examiner* — Gerald J Sufleta, II
(74) *Attorney, Agent, or Firm* — Muncy, Geissler, Olds & Lowe, P.C.

(57) ABSTRACT

A direct-inserting small connector includes an elastic piece and a pin. The elastic piece is installed on a light source plate having a through hole and is completely located above the light source plate. One end of the elastic piece is an output end electrically connected to the light source plate, and the other end thereof forms a clamping end corresponding to the through hole in terms of position. The pin is installed on a drive plate. One end of the pin is an input end electrically connected to the drive plate, and the other end thereof is a direct-inserting end capable of being directly inserted into the clamping end to obtain an electric connection. This connector is suitable for manufacturing high power LED lamps.

8 Claims, 10 Drawing Sheets

(56) References Cited

U.S. PATENT DOCUMENTS

2015/0345766 A1* 12/2015 Wang ..... F21V 23/00
362/382

* cited by examiner

DIRECT-INSERTING SMALL CONNECTOR AND LED LAMP USING SAME

BACKGROUND OF THE INVENTION

1. Field of the Invention

This invention relates particularly to a direct-inserting small connector and to an LED lamp which applies the direct-inserting small connector.

2. Description of the Related Art

Typically, the power connection of an LED lamp is conducted by conducting wires. Two ends of the conducting wire are respectively welded to a light source plate and a drive plate to supply electricity to an LED chip of the light source plate. This electric connection has a complicated operation and causes a high cost for installing the LED lamp. Thus, an automatic installation cannot be executed.

Accordingly, a direct-inserting connector is invented. Referring to FIG. 1, a through hole 110 is formed on a light source plate 100. A first connecting seat 200 is mounted in the through hole 110. An elastic piece 300 is installed in the first connecting seat 200. One end of the elastic piece 300 is an output end 310 electrically connected to the light source plate 100, and the other end thereof is defined as a clamping end 320. A second connecting seat 600 is mounted on a drive plate 400. A pin 500 is installed in the second connecting seat 600. One end of the pin 500 is defined as an input end 510 electrically connected to the drive plate 400, and the other end thereof is defined as a direct-inserting end 520 capable of directly passing through the clamping end 320 to provide a power connection of the LED lamp. This direct-inserting connection replaces the conventional conducting wire and simplifies the electrical connecting structure between the light source plate and the drive plate of the LED lamp. This connection is more convenient to operate, easy to install and process and capable of fulfilling the automatic production.

However, the electric connector, shown in FIG. 1, still has some shortcomings. For example, the output end 310 of the elastic piece 300 is located in the middle of the elastic piece 300, and an elastic part 330 of the elastic piece 300 is located inside a fixing section 210 of the first connecting seat 200 corresponding to the through hole 110 of the light source plate 100. To maintain an elasticity distance D1 of the elastic part 330 and an insertion distance D2 of the pin 500, there is an increase in the volume of the elastic piece 300 and a corresponding increase in the volume of the fixing section 210 of the first connecting seat 200. Especially, the through hole 110 of the light source plate 100 becomes larger. This larger structure is not suitable to make small-sized LED lamps. Thus, the application range is restricted.

SUMMARY OF THE INVENTION

An object of this invention is to provide a direct-inserting small connector with a more compact structure for installation which adapts to LED lamps with different sizes and types and attains a broader application range.

A further object of this invention is to provide an LED lamp using the direct-inserting small connector.

To attain the aforementioned objects, this invention is described as follows:

A direct-inserting small connector includes an elastic piece and a pin. The elastic piece is installed on a light source plate provided with a through hole. The elastic piece is completely located on the light source plate. One end of the elastic piece is defined as an output end which is electrically connected to the light source plate. The other end of the elastic piece forms a clamping end corresponding to the through hole. The pin is installed on a drive plate. One end of the pin is defined as an input end which is electrically connected to the drive plate. The other end of the pin is defined as a direct-inserting end which is capable of being directly inserted into the clamping end to execute an electric connection.

Preferably, the elastic piece includes an elastic part and the clamping end located above than the output end.

Preferably, a first connecting seat is installed on the light source plate. The first connecting seat forms a chamber where the elastic piece is placed. A fixing section is formed at a lower part of the first connecting seat and inserted into the through hole of the light source plate. The fixing section has a direct-inserting hole in communication with the chamber. The elastic piece is disposed across a side wall of the chamber. An elastic part and the clamping end of the elastic piece are located inside the chamber. The clamping end faces the direct-inserting hole. The output end of the elastic piece is located at an outer side of the first connecting seat and provided with a lower part welded to the light source plate in order to fix the first connecting seat to the light source plate.

Preferably, a first connecting seat is installed on the light source plate. The first connecting seat forms a lateral through chamber where the elastic piece is placed. A fixing section is formed at a lower part of the first connecting seat and inserted into the through hole of the light source plate. The fixing section has a direct-inserting hole in communication with the chamber in a longitudinal direction. The first connecting seat has a top plate at a top thereof. An opening where the direct-inserting end of the pin penetrates is formed on the top plate relative to the clamping end and the direct-inserting hole. The opening also communicates with the chamber in a longitudinal direction. An elastic part and the clamping end of the elastic piece penetrate the chamber in a lateral direction. The clamping end faces the direct-inserting hole and the opening. The output end of the elastic piece goes through two sides of the chamber and bends to a lower part of the first connecting seat. The bent output end is then welded to the light source plate in order to fix the first connecting seat to the light source plate.

Preferable, a lower mouth of the direct-inserting hole is wider than an upper mouth of the direct-inserting hole.

Preferable, the elastic piece is a single metal plate or is made of two symmetrical metal plates.

Preferable, the pin is formed in an acicular shape. A second connecting seat is installed on the drive plate. The second connecting seat has a pillar fitting an aperture formed on the drive plate in order to fix the second connecting seat to the drive plate. The second connecting seat has a pin hole for an insertion of the pin.

Preferably, the pin is a conducting wire whose one end is electrically connected to the drive plate and whose other end is defined as the direct-inserting end.

Preferably, the pin is a printed circuit board (PCB). The PCB and the drive plate are integral to each other, or the two elements are separately formed and electrically connected to each other. A conducting plate is disposed on the direct-inserting end of the PCB.

An LED lamp using the direct-inserting small connector is disclosed. A drive plate and a light source plate are installed within the LED lamp. The drive plate is located below the light source plate. The light source plate and the drive plate have an electric connection via the direct-inserting small connector.

Preferably, the light source plate can have an LED light source or a plurality of LED light sources disposed thereon.

By comparison with the prior art, this invention takes advantages of the elastic piece which is completely disposed above the light source plate to allow the elastic part and the clamping end of the elastic piece to be located above the light source plate instead of being located inside the through hole of the light source plate. Thus, the size of the through hole is neither affected by the elasticity distance of the elastic part and the insertion distance of the pin nor affected by the volume of the elastic piece. Thus, the through hole can have a smaller size, and the installation of the structure can be more compact so that this invention can be applied to LED lamps with different sizes and types, especially to small-sized LED lamps and can have a broader application range. For LED lamps with the same sizes and types, this invention helps install the structure more compactly and allows more LED light sources to be installed on the light source plate, thereby manufacturing an LED lamp with high power.

The detailed description of this invention is more apparent upon reading following preferred embodiments in conjunction with accompanying drawings.

DETAILED DESCRIPTION OF THE PREFERRED EMBODIMENTS

Figure 1:
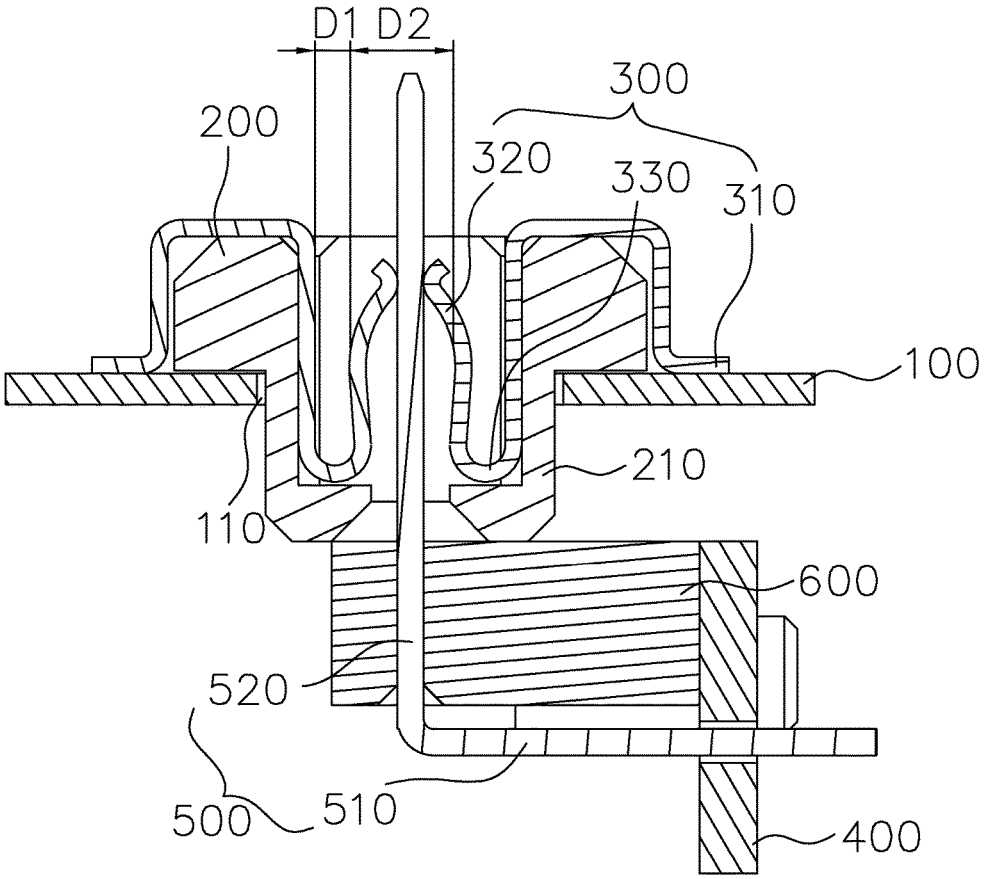
F I G. 1 PRIOR ART
FIG. 1 is a cross-sectional view showing a conventional direct-inserting small connector.
Figure 2:
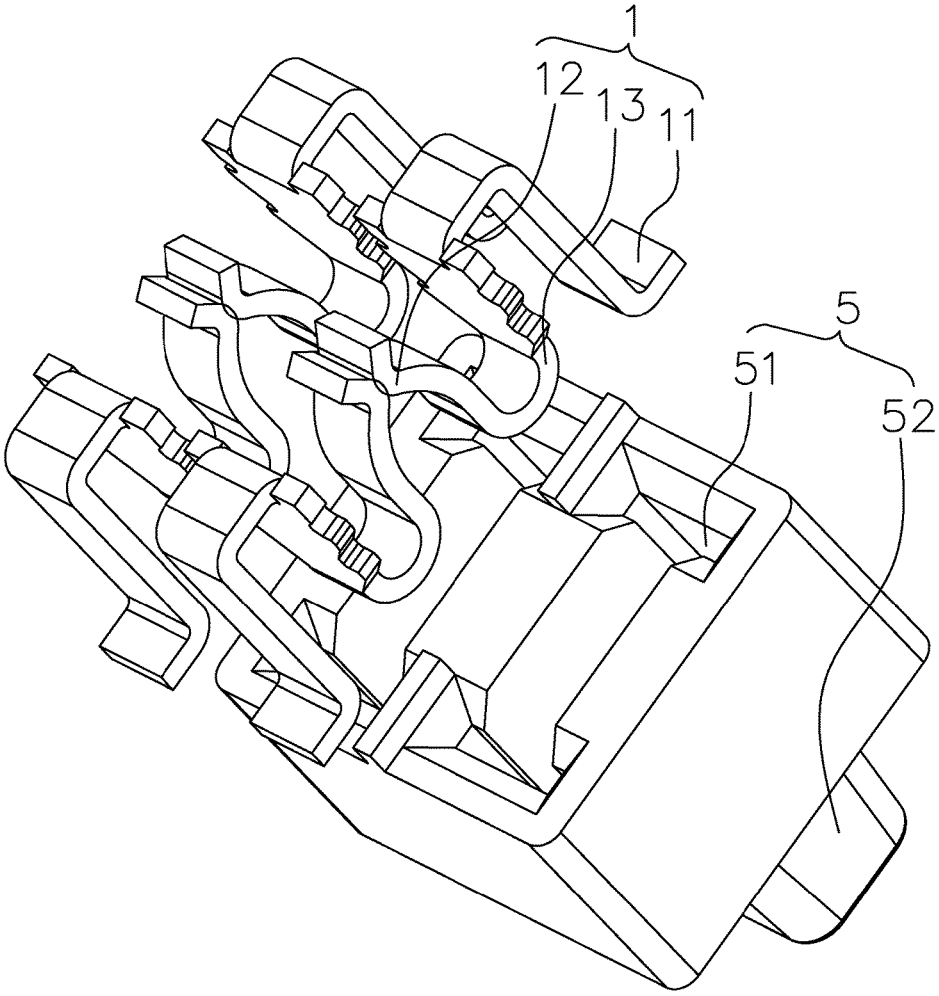
FIG. 2 is a top perspective view showing an elastic piece and a first connecting seat of a first preferred embodiment of the direct-inserting small connector of this invention.
Figure 3:
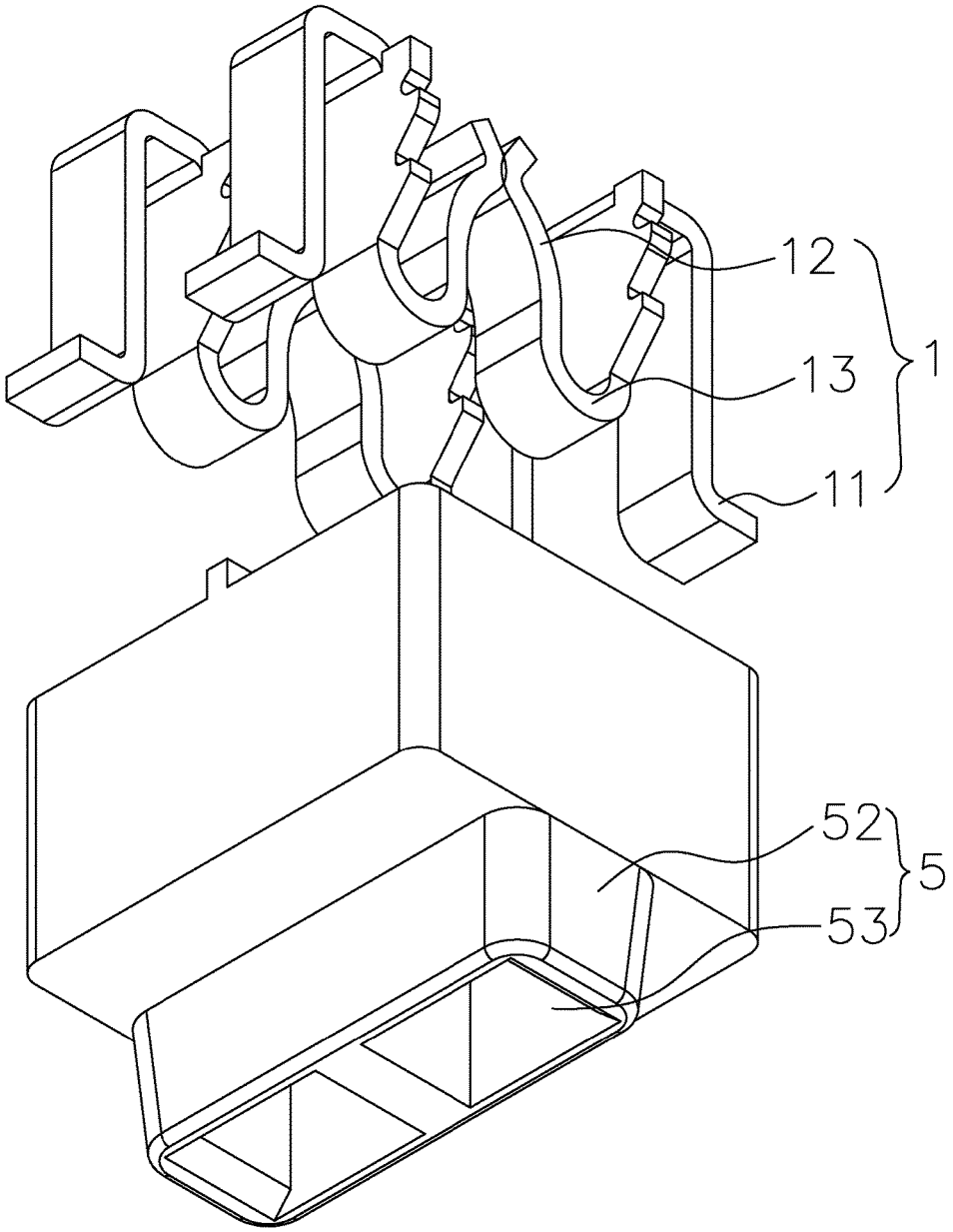
FIG. 3 is a bottom perspective view showing the elastic piece and the first connecting seat of the first preferred embodiment of the direct-inserting small connector of this invention.
Figure 4:
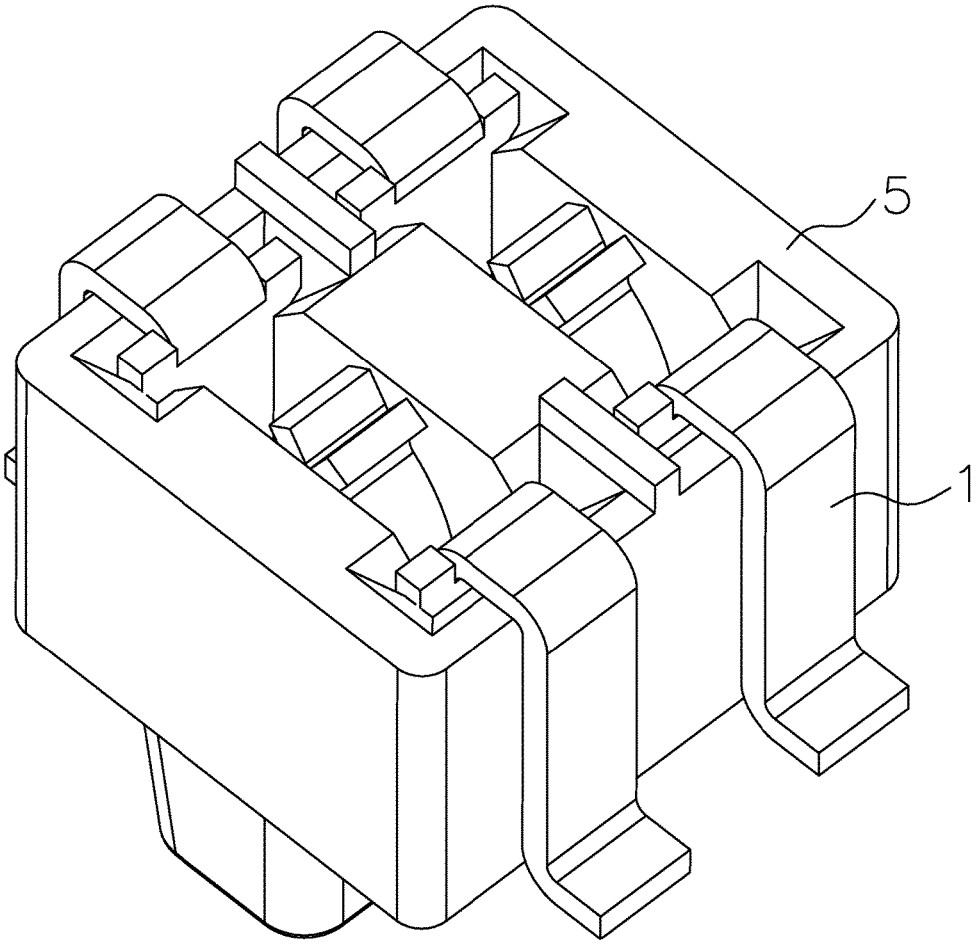
FIG. 4 is a perspective view showing the elastic piece in combination with the first connecting seat of the first preferred embodiment of the direct-inserting small connector of this invention.
Figure 5:
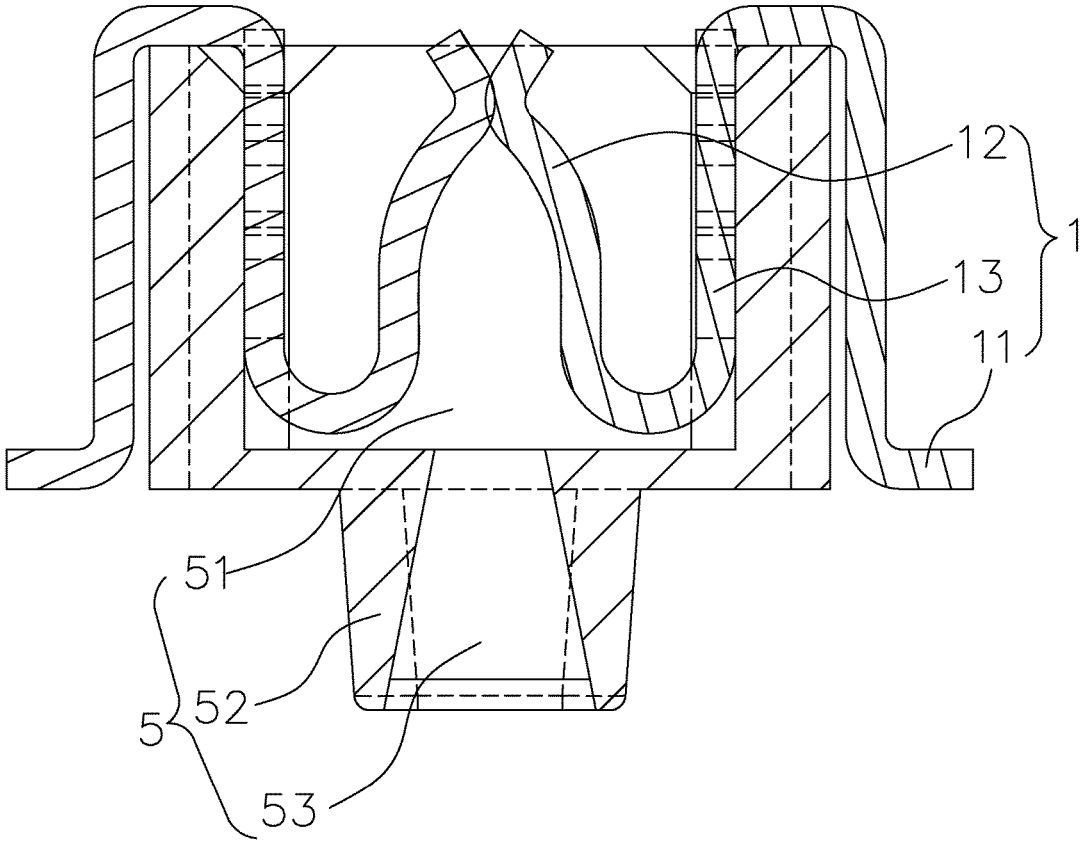
FIG. 5 is a cross-sectional view showing the elastic piece in combination with the first connecting seat of the first preferred embodiment of the direct-inserting small connector of this invention.
Figure 6:
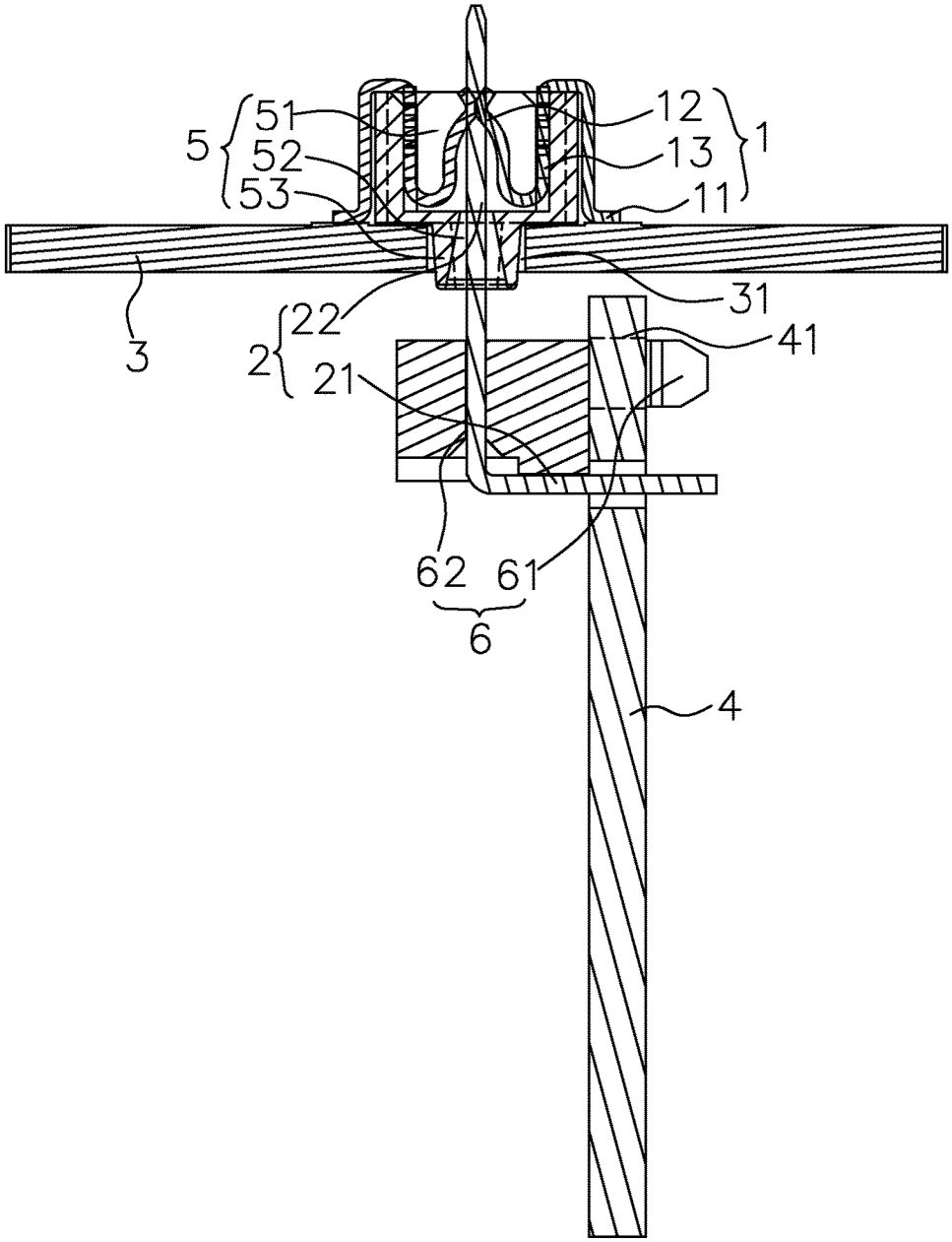
FIG. 6 is a cross-sectional view showing the first preferred embodiment of the direct-inserting small connector of this invention.

FIGS. 2-6 and FIGS. 8-10 are two preferred embodiments of the direct-inserting small connector of this invention which includes an elastic piece 1 and a pin 2.

The elastic piece 1 is installed on a light source plate 3 provided with a through hole 31. The elastic piece 1 is completely located above the light source plate 3. One end of the elastic piece 1 is defined as an output end 11 which is electrically connected to the light source plate 3, and the other end thereof forms a clamping end 12 corresponding to the through hole 31. In these two preferred embodiments, the output end 11 of the elastic piece 1 is located at the lowest position to allow an elastic part 13 and the clamping end 12 of the elastic piece 1 to be located above the output end 11. Thus, the elastic piece 1 can be wholly located above the light source plate 3. The elastic piece 1 can be a single metal plate. Alternatively, the elastic piece 1 can be made of two symmetrical metal plates, as shown in the embodiments.

The pin 2 is installed on a drive plate 4. One end of the pin 2 is defined as an input end 21 which is electrically connected to the drive plate 4, and the other end thereof is defined as a direct-inserting end 22 capable of being directly inserted into the clamping end 12 to execute an electric connection.

To obtain an easy installation of the elastic piece 1, a first preferred embodiment shown from FIG. 2 to FIG. 6 installs a first connecting seat 5 on the light source plate 3. In this preferred embodiment, the first connecting seat 5 forms a chamber 51 where the elastic piece 1 can be placed. A fixing section 52 is formed at a lower part of the first connecting seat 5 and inserted into the through hole 31 of the light source plate 3. The fixing section 52 further has a direct-inserting hole 53 in communication with the chamber 51 for an insertion of the pin 2. The direct-inserting hole 53 has a shape whose lower mouth is wider than an upper mouth, thereby passing the pin 2 through the hole more smoothly. Specifically, this preferred embodiment shows that the elastic piece 1 is disposed across a side wall of the chamber 51. The elastic part 13 and the clamping end 12 of the elastic piece 1 are located inside the chamber 51. The clamping end 12 faces the direct-inserting hole 53. The output end 11 of the elastic piece 1 is located at an outer side of the first connecting seat 1 and provided with a lower part welded to the light source plate 3 in order to fix the first connecting seat 5 to the light source plate 3.

Figure 8:
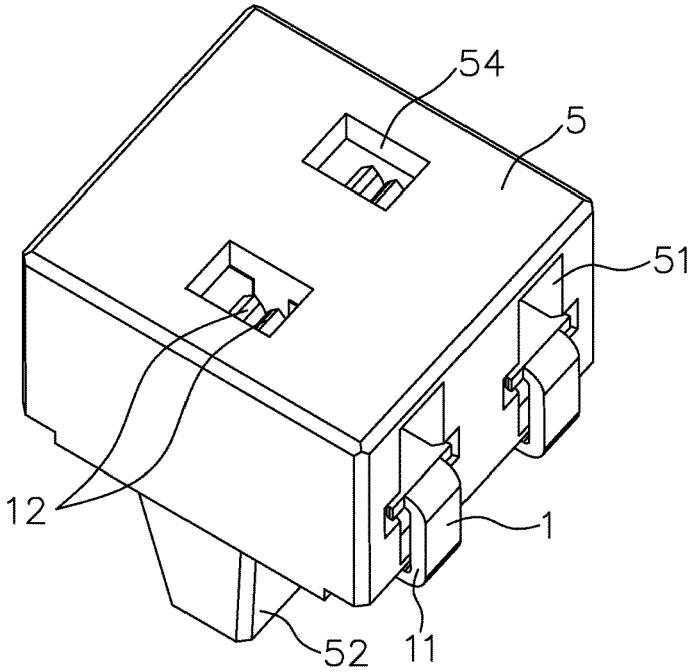
FIG. 8 is a top perspective view showing an elastic piece and a first connecting seat of a second preferred embodiment of the direct-inserting small connector of this invention.
Figure 9:
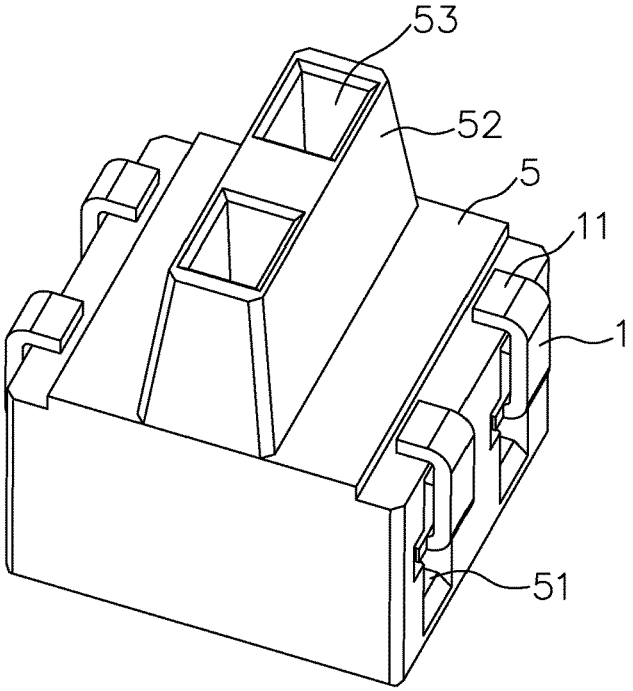
FIG. 9 is a bottom perspective view showing the elastic piece and the first connecting seat of the second preferred embodiment of the direct-inserting small connector of this invention.
Figure 10:
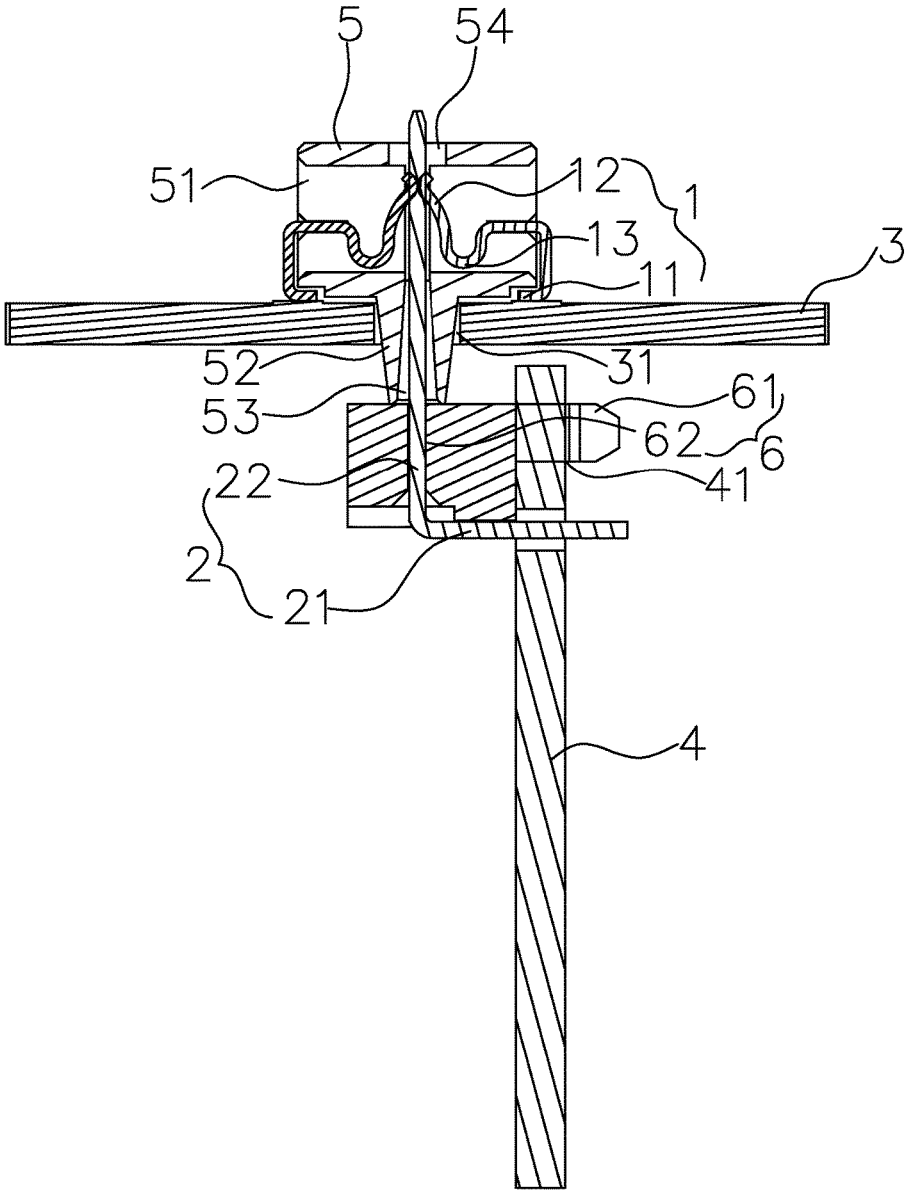
FIG. 10 is a cross-sectional view showing the second preferred embodiment of the direct-inserting small connector of this invention.

A second preferred embodiment of this invention, shown in FIG. 8 and FIG. 9, also installs a first connecting seat 5 on the light source plate 3. The first connecting seat 5 forms a lateral through chamber 51 where the elastic piece 1 is placed. A fixing section 52 is formed at a lower part of the first connecting seat 5 and inserted into the through hole 31 of the light source plate 3. The fixing section 52 has a direct-inserting hole 53 in communication with the chamber 51 in a longitudinal direction, so the pin 2 can be inserted into the hole. The direct-inserting hole 53 has a shape whose lower mouth is wider than an upper mouth, thereby passing the pin 2 through the hole more smoothly. The first connecting seat 5 further has a top plate at a top thereof. An opening 54 is formed on the top plate relative to the clamping end 12 and the direct-inserting hole 53 so that the direct-inserting end 22 of the pin 2 can pass therethrough. The opening 54 also communicates with the chamber 51 in a longitudinal direction. In this preferred embodiment, the elastic part 13 and the clamping end 12 of the elastic piece 1 penetrate the chamber 51 in a lateral direction. A lower part of the elastic piece 13 directs against the chamber 51. The clamping end 12 faces the direct-inserting hole 53 and the opening 54. The output end 11 of the elastic piece 1 passes through two sides of the chamber 51 and bends to a lower part of the first connecting seat 5. The bent output end 11 is then welded to the light source plate 3 in order to fix the first connecting seat 5 to the light source plate 3.

To obtain an easy installation of the pin 2, the first preferred embodiment and the second preferred embodiment further install a second connecting seat 6 on the drive plate 4. The second connecting seat 6 has a pillar 61 fitting an aperture 41 formed on the drive plate 4 in order to fix the second connecting seat 6 to the drive plate 4. The second connecting seat 6 has a pin hole 62 where the pin 2 is inserted. Herein, the pin 2 is formed in an acicular shape. If the pin 2 is a PCB, there is no need to provide the second connecting seat 6. The PCB and the drive plate 4 can be integral to each other, or the PCB and the drive plate can be separately formed and electrically connected to each other. A conducting plate is disposed on the direct-inserting end 22 of the PCB. The pin 2 can also be a conducting wire whose one end is electrically connected to the drive plate 4 and whose other end is defined as the direct-inserting end 22 to cooperate with the clamping end 12 of the elastic piece 1. Thus, an electric connection can be conducted.

Figure 7:
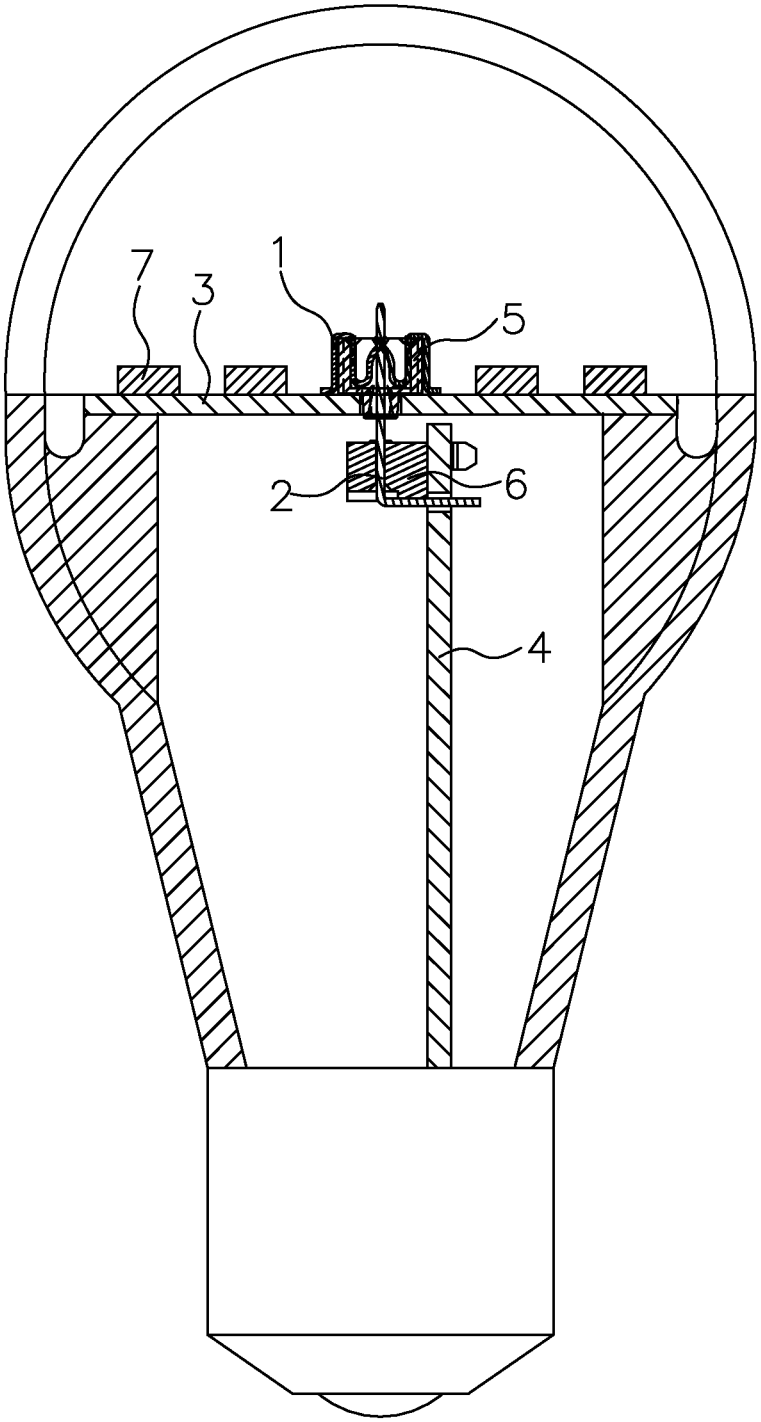
FIG. 7 is a schematic view showing the first preferred embodiment of the direct-inserting small connector of this invention applied to an LED lamp.
Figure 11:
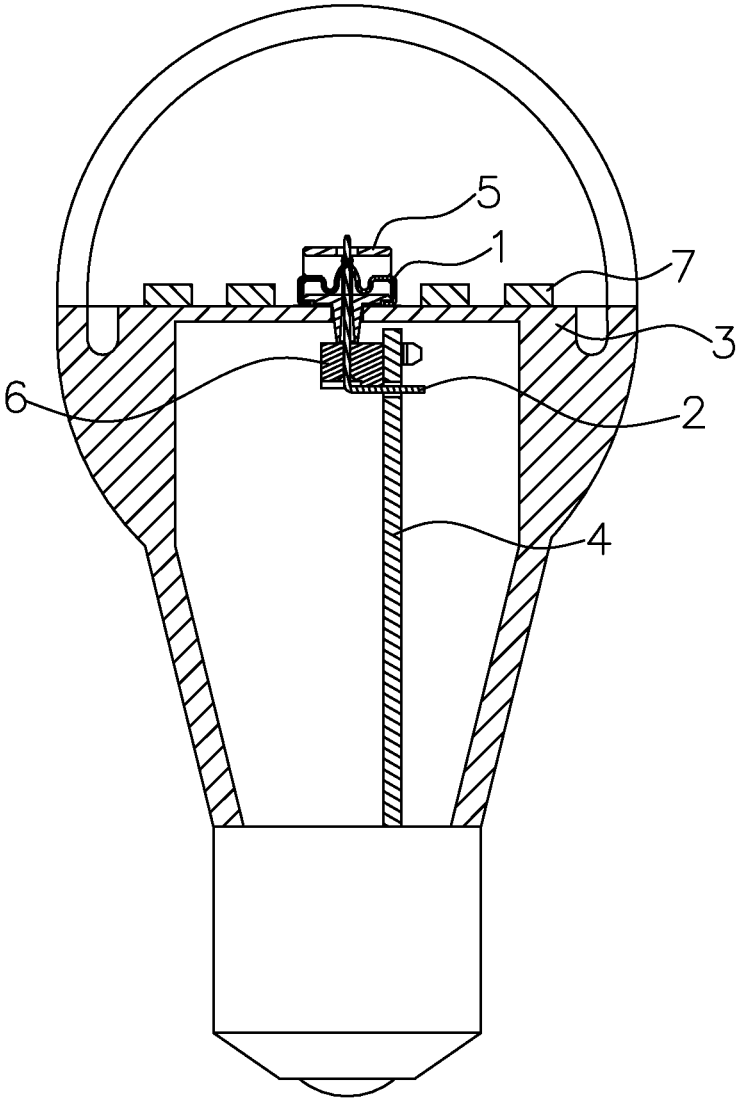
FIG. 11 is a schematic view showing the second preferred embodiment of the direct-inserting small connector of this invention applied to an LED lamp.

When the two preferred embodiments of the direct-inserting small connector are applied to an LED lamp shown in FIG. 7 and FIG. 11, the drive plate 4 and the light source plate 3 are installed within the LED lamp. Specifically, the drive plate 4 is located below the light source plate 3. An LED light source or LED light sources 7 can be disposed on the light source plate 3. The light source plate 3 and the drive plate 4 have an electric connection via the direct-inserting small connector in order to supply electricity to the LED light sources 7 for illumination.

The installation of the direct-inserting small connector of this invention is more compact, so the through hole 31 of the light source plate 3 has a smaller size and occupies less superficial area of the light source plate 3. The volume of the light source plate 3 can also shrink to adapt to a production of small-sized LED lamps. For LED lamps with the same sizes and types, more LED light sources 7 can be mounted on the light source plate 3 to manufacture an LED lamp with high power.

While the embodiments of this invention are shown and described, it is understood that further variations and modifications may be made without departing from the scope of this invention.

What is claimed is:

1. A direct-inserting small connector comprising an elastic piece and a pin, said elastic piece being installed on a light source plate provided with a through hole, said elastic piece being completely located above said light source plate, one end of said elastic piece being defined as an output end which is electrically connected to said light source plate, another end of said elastic piece forming a clamping end corresponding to said through hole, said pin being installed on a drive plate, one end of said pin being defined as an input end which is electrically connected to said drive plate, another end of said pin being defined as a direct-inserting end capable of being directly inserted into said clamping end to execute an electric connection.

2. The direct-inserting small connector as claimed in claim 1, wherein said elastic piece includes an elastic part and said clamping end which are all located above said output end.

3. The direct-inserting small connector as claimed in claim 1, wherein a first connecting seat is installed on said light source plate, said first connecting seat forming a chamber where said elastic piece is placed, a fixing section being formed at a lower part of said first connecting seat and inserted into said through hole of said light source plate, said fixing section having a direct-inserting hole in communication with said chamber, said elastic piece being disposed across a side wall of said chamber, an elastic part and said clamping end of said elastic piece being located inside said chamber, said clamping end facing said direct-inserting hole, said output end of said elastic piece being located at an outer side of said first connecting seat and provided with a lower part welded to said light source plate in order to fix said first connecting seat to said light source plate.

4. The direct-inserting small connector as claimed in claim 1, wherein a first connecting seat is installed on said light source plate, said first connecting seat forming a lateral through chamber where said elastic piece is placed, a fixing section being formed at a lower part of said first connecting seat and inserted into said through hole of said light source plate, said fixing section having a direct-inserting hole in communication with said chamber in a longitudinal direction, said first connecting seat having a top plate at a top thereof, an opening where said direct-inserting end of said pin penetrates being formed on said top plate relative to said clamping end and said direct-inserting hole and being in communication with said chamber in a longitudinal direction, an elastic part and said clamping end of said elastic piece penetrating said chamber in a lateral direction, said clamping end facing said direct-inserting hole and said opening, said output end of said elastic piece passing through two sides of said chamber and thence bending to a lower part of said first connecting seat to be welded to said light source plate, thereby fixing said first connecting seat to said light source plate.

5. The direct-inserting small connector as claimed in claim 3 or 4, wherein a lower mouth of said direct-inserting hole is wider than an upper mouth of said direct-inserting hole.

6. The direct-inserting small connector as claimed in claim 1, wherein said elastic piece is a single metal plate or is made of two symmetrical metal plates.

7. The direct-inserting small connector as claimed in claim 1, wherein said pin is formed in an acicular shape, a second connecting seat being installed on said drive plate, said second connecting seat having a pillar fitting an aperture formed on said drive plate in order to fix said second connecting seat to said drive plate, said second connecting seat having a pin hole where said pin is inserted.

8. The direct-inserting small connector as claimed in claim 1, wherein said pin is a conducting wire whose one end is electrically connected to said drive plate and whose other end is defined as said direct-inserting end.

* * * * *